US006902423B2

(12) United States Patent
Castaldo et al.

(10) Patent No.: US 6,902,423 B2
(45) **Date of Patent: *Jun. 7, 2005**

(54) TWO WIRE FOLDER LINE PLUGS AND CONNECTORS

(75) Inventors: Cosmo Castaldo, Westbury, NY (US); Anthony Tufano, Jr., Seaford, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/647,001

(22) Filed: Aug. 22, 2003

(65) Prior Publication Data

US 2004/0110426 A1 Jun. 10, 2004

Related U.S. Application Data

(63) Continuation-in-part of application No. 09/911,923, filed on Jul. 24, 2001, now Pat. No. 6,695,639.

(51) Int. Cl.[7] ..... H01R 13/58
(52) U.S. Cl. ..... 439/467
(58) Field of Search ..... 439/696, 470, 439/467, 459, 464, 134, 465, 460, 469, 409; 200/51.2

(56) References Cited

U.S. PATENT DOCUMENTS

| | | | | |
|---|---|---|---|---|
| 2,505,518 A | | 4/1950 | Benander | 200/51.06 |
| 3,810,075 A | | 5/1974 | Turner | |
| 3,981,555 A | | 9/1976 | Deurloo | 339/105 |
| 4,191,444 A | | 3/1980 | Smith et al. | |
| 4,210,380 A | | 7/1980 | Brzostek | 339/107 |
| 4,432,593 A | | 2/1984 | Waluk | 339/105 |
| 4,759,723 A | * | 7/1988 | Siemon | 439/409 |
| 5,378,163 A | * | 1/1995 | Gladura et al. | 439/134 |
| 5,514,006 A | | 5/1996 | Getselis et al. | 439/417 |
| 5,591,046 A | | 1/1997 | Klein et al. | 439/467 |
| 5,782,653 A | | 7/1998 | Sandor | 439/467 |
| 5,885,099 A | | 3/1999 | Sandoc | |
| 5,934,931 A | | 8/1999 | Castaldo | 439/467 |
| 5,975,941 A | | 11/1999 | Castaldo | 439/469 |
| 6,056,588 A | | 5/2000 | Castaldo | 439/469 |
| 6,074,238 A | * | 6/2000 | DeRoss et al. | 439/409 |
| 6,126,478 A | | 10/2000 | Presson et al. | 439/467 |
| 6,695,639 B2 | | 2/2004 | Castaldo et al. | |

* cited by examiner

*Primary Examiner*—Alexander Gilman
(74) *Attorney, Agent, or Firm*—Paul J. Sutton

(57) ABSTRACT

An electrical connector assembly receives exposed ends of an electrical wire, and includes a foldable body with complementary first and second body portions and components for securely mounting a third body portion in the assembly using a single fastening screw, and for mounting the exposed ends to electrical contacts of an electrical connector device attached to the third body portion and securely mounted in the folded and assembled body portions. The components on the body portions include posts, ribs, and bridges for relieving strain on the electrical wire in the assembly, and other ribs and interlocking components prevent the electrical connector assembly from allowing the wires, the electrical connector device, and/or the third body portion from being removed from the folded and assembled electrical connector assembly.

23 Claims, 7 Drawing Sheets

TWO WIRE FOLDER LINE PLUGS AND CONNECTORS

CROSS-REFERENCE TO RELATED APPLICATIONS

This application is a continuation-in-part of application Ser. No. 09/911,923 filed Jul. 24,2001, now U.S. Pat. No. 6,695,639.

STATEMENT REGARDING FEDERALLY SPONSORED RESEARCH OR DEVELOPMENT

Not Applicable

BACKGROUND OF THE INVENTION

1. Field of the Invention

The present invention relates to electrical connectors for terminating electrical wires and cords, and more particularly to a strain-relief device used with electrical connectors to prevent forces applied to the electrical wires and cords affecting the connector or the connections made therein.

2. Description of the Related Art

In the manufacture of plugs, sockets, and other components in electrical wiring, for example, disposed at the ends of electrical cords such as extension cords, such plugs and sockets are typically fabricated as foldable assemblies between which the wires of the electrical cords are securely held and attached to electrical connector devices mounted in the folded and assembled electrical connector assembly. Example implementations of such foldable electrical connector assemblies are described in U.S. Pat. Nos. 5,934,931; 5,975,941; and 6,056,588, each of which is incorporated herein by reference, which provide components to securely mount the cords and wires into the assemblies and which provide strain relief on the assemblies and the wires when the cores and/or wires are moved or pulled.

Heretofore, such folded and assembled electrical connector assemblies experienced weakening of their structural integrity in response to various pressures or stresses applied from different sources and directions. For example, prior art electrical connector assemblies have used fastening screws to hold the folded assembly in the folded configuration. However, such fastening screws have typically been incapable of securely holding the entire folded and assembled electrical connector assembly together in response to diverse sources of pressure or stress, such as pulling the mounted wires outward from the folded assembly.

A need exists for mechanisms which supplement the retaining capabilities of fastening screws or other fastening devices to securely hold the entire folded and assembled electrical connector assembly together, and so to relieve the strain experienced by the fastening screws/devices.

In the prior art, a foldable electrical connector assembly typically utilizes multiple fastening screws to maintain the structural integrity of the folded and assembled electrical connector assembly. Such use of multiple fastening screws complicate fabrication of the foldable electrical connector assembly and also increase the time and effort of a user to completely fold and secure an electrical connector assembly onto or about inserted wires.

A need exists for a foldable electrical connector assembly requiring a single fastening screw to reduce fabrication complexity and to improve the ability of a user to completely and securely assembly the electrical connector assembly with inserted wires.

In addition, in the prior art, such foldable assemblies typically utilize flexible/living hinges between portions of the unfolded electrical connector assembly, such that the portions are rotated around the living hinges to engage complementary portions to mount the wires and other components between the complementary portions. The hinges also function to keep the folded assembly together. However, due to external factors such as age and the application of external sources of pressure, such hinges may wear out or otherwise break, which may result in the dissolution of the folded and assembled electrical connector assembly.

A need exists for additional safeguards and mechanisms of foldable electrical connector assemblies to maintain the structural integrity of the folded assemblies even though any of the hinges between portions of the assemblies may break.

Furthermore, although strain relief mechanisms are known in the prior art, such strain relief mechanisms may limit the path of the wires mounted in the foldable electrical connector assemblies. For example, prior art strain relief mechanisms may cause exposed ends of the wire having different electrical characteristics, such as polarity, to engage each other.

A need exists for providing an improved path for the wires in the interior of the foldable electrical connector assembly to be disposed near an internally-positioned electrical connector device, and for providing such strain relief of wires running along the improved path.

BRIEF SUMMARY OF THE INVENTION

An electrical connector assembly receives exposed ends of an electrical wire, and includes a foldable body with complementary first and second body portions and components for securely mounting a third body portion in the assembly using a single fastening screw, and for mounting the exposed ends to electrical contacts of an electrical connector device attached to the third body portion and securely mounted in the folded and assembled body portions. The components on the body portions include posts, ribs, and bridges for relieving strain on the electrical wire in the assembly, and other ribs and interlocking components prevent the electrical connector assembly from allowing the wires, the electrical connector device, and/or the third body portion from being removed from the folded and assembled electrical connector assembly.

DETAILED DESCRIPTION OF THE INVENTION

Figure 1:
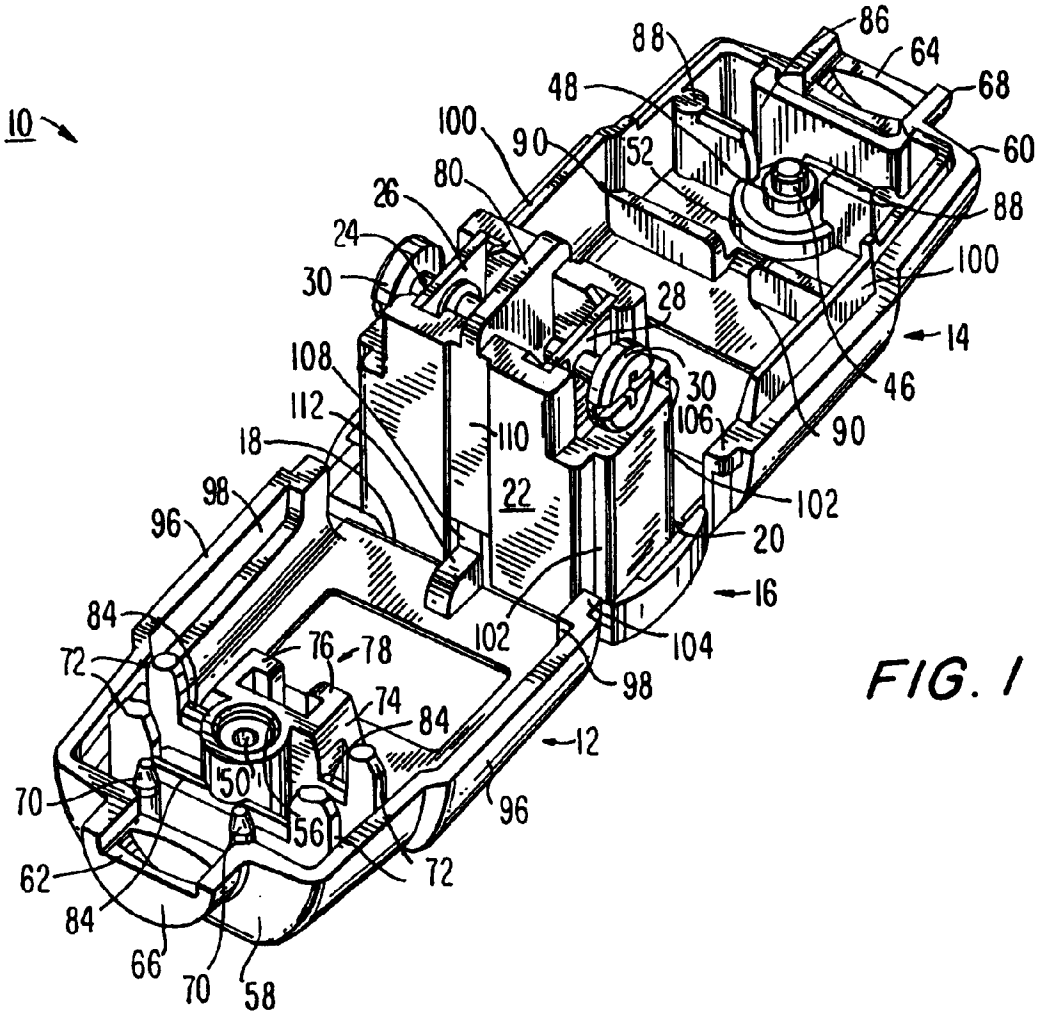
FIG. 1 illustrates a top perspective view of a foldable electrical connector assembly.
Figure 2:
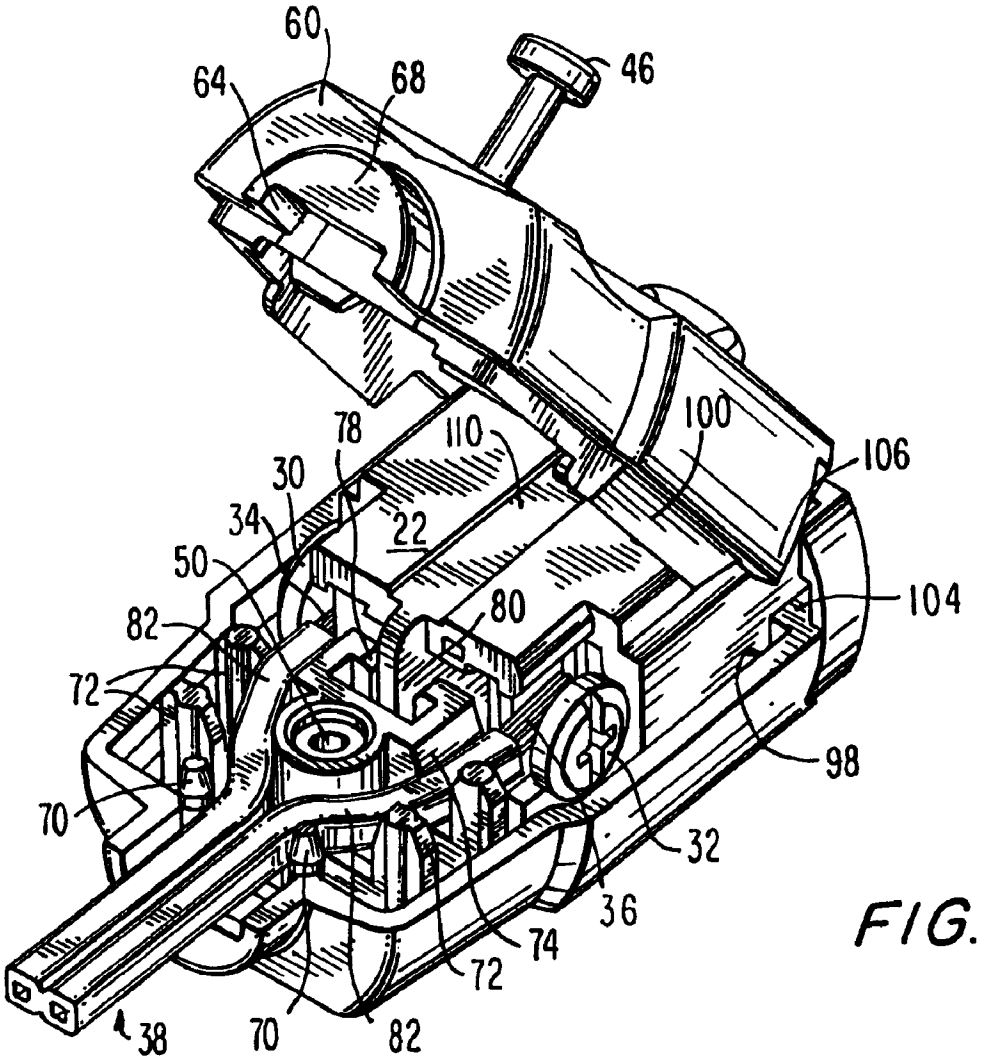
FIG. 2 illustrates a top perspective view of the electrical connector assembly of FIG. 1 in a partially folded state.
Figure 3:
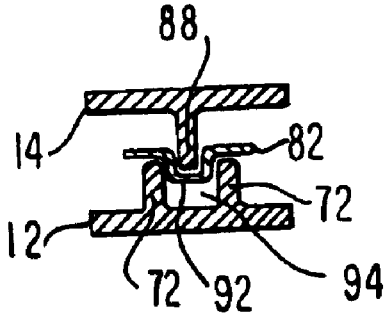
FIG. 3 illustrates a cross-sectional side view of a strain relief mechanism with ribs engaging an electrical wire therebetween.

As shown in FIGS. 1–3, a foldable electrical connector assembly 10, for use in line plugs and connectors such as electrical sockets, incorporates numerous features including strain-relief components, as well as various ribs and interlocking components for improved fabrication, manufacture, and final assembly of the folded and assembled electrical connector assembly 10.

Referring to FIG. 1, the foldable electrical connector assembly 10 includes a first body portion 12, a second body portion 14, and a third body portion 16, forming a split body configuration extending longitudinally, which may be folded and assembled as shown in FIG. 2 in a partial assembly state. The body portions 12—are fully assembled as shown in FIGS. 4–10, with the body portions 12—surrounding the third body portion 16, with a section of the third body portion 16 being externally exposed to present electrical socket terminals and/or electrical plug terminals. In a preferred embodiment, the foldable electrical connector assembly 10 has each of the first body portion 12 and the second body portion 14 connected to the third body portion 16 by respective hinges 18, 20, which may be composed of resilient and/or bendable plastic material to be a living hinge, permitting the body portions 12–16 to be folded about a transverse axis, as shown in FIG. 2, relative to the longitudinal length of the split body configuration shown in FIG. 1.

In one embodiment, the body portions 12–16 and the hinges 18, 20 may be formed as an integral piece from known fabrication techniques, for example, dye–cast molding of plastic materials or other electrically insulating materials known in the art, such as rubber, glass, and/or composite materials. In alternative embodiments, the body portions 12–16 may be independently fabricated and attached to each other by heat-sealing contacting edges of the first body portion 12 to the third body portion 16 and of the second body portion 14 to the third body portion 16 to form the resilient and/or bendable hinges 18, 20 from the heat sealing process. In other alternative embodiments, independently fabricated body portions 12–16 may be attached to each other as shown in FIG. 1 by separate hinge devices as the hinges 18, 20, such as axial-rotating hinge flanges or bending flanges, composed of plastic, metal, or other materials.

As shown in FIGS. 1–2, the third body portion 16 has a body 22 in which or to which is mounted or is housed an electrical connector device 24 including contact assemblies known in the art and having conductive contact pads 26, 28 with apertures through which conductive screws 30, 32 may be removable mounted for removably attaching exposed conductive ends 34, 36 of wires, such as insulated wires 38, as shown in greater detail in FIG. 2. In an example embodiment, the electrical connector device 24 may have the components such that the folded and assembled electrical connector assembly 10 functions as a two-prong socket, such as the socket 40 in FIG. 4. In other embodiments, the electrical connector device 24 may have the components such that the folded and assembled electrical connector assembly 10 functions as a two-prong plug, such as the plug 42 in FIG. 4. In the example embodiments shown in FIG. 4, the two-prong plugs and sockets using the folded and assembled electrical connector assembly 10 are configured as straight plugs and sockets, but may alternatively be configured as three-prong straight plugs and sockets. In other embodiments, the folded and assembled electrical connector assembly 10 may be configured as two-prong or three-prong side-oriented and/or angularly-oriented plugs and sockets, such as the plug 44 having a right-angle orientation shown in FIG. 8.

Such electrical connector assemblies 10 and electrical connector devices 24 shown in FIGS. 1–2 may be implemented as described in U.S. Pat. Nos. 5,934,931; 5,975,941; and 6,056,588, each of which is incorporated herein by reference; and such implementations of electrical connector assemblies 10 and electrical connector devices 24 may be modified, as described herein, to implement the disclosed advantages and features using strain-relief components as well as various ribs and interlocking components for improved assembly of the folded and assembled electrical connector assembly 10.

The body portions 12–14 are fabricated to be complementary, with opposing surfaces which are brought into engagement with each other when the first body portion 12 is folded about the living hinge 18, and when the second body portion 14 is folded about living hinge 20. In a preferred embodiment, the body portions 12–14 are held together in the completed assembly configuration, shown for example in FIG. 3, by known fastening or securing devices and techniques. In a preferred embodiment, the body portions 12–14 are held together by a screw 46 or other known threaded fasteners extending through an aperture 48 in the second body portion 14, to engage and be secured in a threaded fastener receiving socket 50 of the first body portion 12.

In the preferred embodiment, a single screw 46 is used to hold the body portions 12–14 together and, in conjunction with the various ribs of the body portions 12–14, described herein, the body portions 12–14 are securely assembled with the third body portion 16 positioned in the assembled body portions 12–14.

In alternative embodiments, multiple screws, apertures, and fastener receiving sockets similar to the screw 46, aperture 48, and socket 50 may be used in the electrical connector assembly 10; for example, as shown in U.S. Pat. Nos. 5,934,931; 5,975,941; and 6,056,588, incorporated herein by reference. In further alternative embodiments, the body portions 12–14 and optionally the third body portion 16 may be heat sealed together, or otherwise a known adhesive may be selectively applied to secure the body portions 12–14 or the body portions 12–16 together to form the assembled electrical connector assembly 10, as shown in FIGS. 4–10.

The aperture 48 and/or the screw and/or fastener receiving socket 50 may be formed as extensions of the respective body portions 12–14, with the extensions being oriented to be disposed in the interior of the folded and assembled electrical connector assembly 10. In alternative embodiments, the aperture 48 may be in the first body portion 12 and the fastener receiving socket 50 may be in the second body portion 14, and each body portion 12–14 may include corresponding extensions formed from the respective body portion 12–14. In further embodiments, the aperture 48 may be formed in a raised portion 52, which may correspond to a recess 54 in the exterior surface of the second body portion 14, shown in FIG. 4, in which the head of the screw 46 is disposed to be flush with or below the exterior surface of the second body portion 14.

Figure 4:
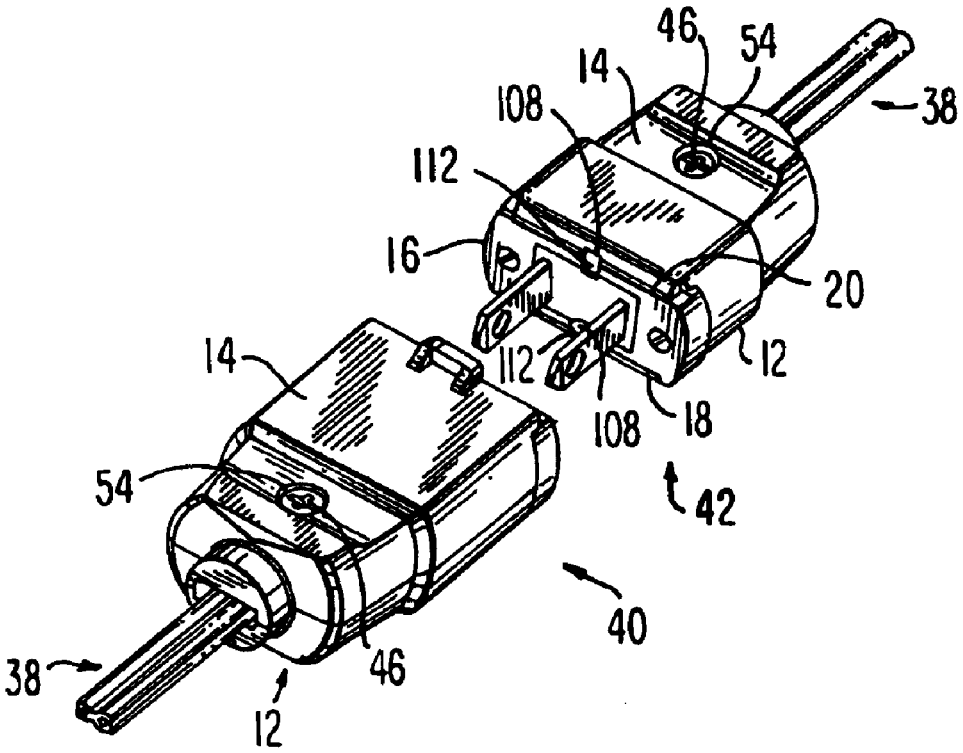
FIG. 4 illustrates a top perspective view of two embodiments of the folded and assembled electrical connector assembly of FIG. 1 in a plug configuration and in a socket configuration.

The raised portion 52 may complement shelf-like walls 56 in the recess 50, such that the raised portion 52 fits in and engages the walls 56 when the body portions 12–14 are folded to engage each other, as shown in FIG. 2, with the walls 56 holding the raised portion 52 and therefore the second body portion 14 in place adjacent to the first body portion 12 until and after the screw 46 is threaded and secured in the threaded recess 50 to secure the body portions 12–14 together in the assembled configuration shown in FIG. 4.

The body portions 12–14 have end walls 58, 60, respectively, in which respective wire apertures 62, 64 are disposed, optionally on wire holding extension structures 66, 68, respectively, extending from the end walls 58, 60, respectively. The apertures 62–64 may be rectangular slots, shown in FIG. 1, or may be semi-circular or other shapes, to receive one or more wires 38, as shown in FIG. 2, and so to pass the wires 38 into the electrical connector assembly 10, in which the wires 38 may split to separate branches of wires 82 with exposed ends 34, 36 to be connected to the conducting screws 30, 32, as shown in FIG. 2 and described herein.

The electrical connector assembly 10 also includes a plurality of extensions from the body portions 12–14, including posts, ribs, bridges, and other structures and components, for providing a path for the wires 38, 82 to run from the exterior to the interior of the electrical connector assembly 10, and a plurality of ribs are included for providing strain relief for the wires 38, 82 from the effects of bending or other manipulation or movement of the wires 38, 82 after installation into the folded electrical connector assembly 10. In a preferred embodiment, some of the posts may also function as strain-relief ribs and vice versa.

In the example shown in FIGS. 1–2, the first body portion 12 includes a first plurality of guiding posts 70, a second plurality of guiding posts 72, and an extension 74. The extension 74 may be fabricated, for example, to be integral with the fastener receiving socket 50, and optionally the guiding posts 70, 72 may be fabricated to be integral with the fastener receiving socket 50 and/or to extend from the first body portion 12. As explained herein, the extension 74 may include side walls 76 forming a slot 78 therebetween for engaging a rib 80 on the third body portion 16.

As shown in FIG. 2, the wires 38 are split to form a pair of wire lengths 82 having the exposed ends 34, 36, with each of the wire lengths 82 passing through the path formed between the guiding posts 70, 72 and the fastener-receiving socket 50 and the side walls 76 of the extension 74, such that the exposed ends 34, 36 are positioned in the internal regions of the first body portion 12 to be substantially adjacent to the screws 30, 32 to be threaded and to electrically contact the screws 30, 32.

Thus, the guiding posts 70, 72, extending in a longitudinal direction, operate in conjunction with the fastener-receiving socket 50 and the side walls 76 of the extension 74 to form a snug path for the wires 38, 82 to pass through.

The first plurality of guiding posts 70 and/or the second plurality of guiding posts 72 may include ribs and/or bridges 84 extending from the first body portion 12 which engage complementary ribs 86, 88, 90 of the second body portion 14. The plurality of ribs 86, 88, 90 are spaced apart from each other in a longitudinal direction, and provide strain-relief when the second body portion 14 is folded over, as shown in FIG. 2, to engage the first body portion 12, such that the wires 38, 82 are squeezed between the ribs 84 of the first body portion 12 and the ribs 86, 88, 90 of the second body portion 14, as shown in a partial view in FIG. 4.

In a preferred embodiment, when the body portions 12, 14 are folded together to be assembled, a first rib 86 is positioned in the longitudinal direction between the first guiding posts 70 and the second guiding posts 72; a pair of second ribs 88 is positioned in the longitudinal direction between the pair of second guiding posts 72; and a third pair of ribs 90 is positioned in the longitudinal direction after the last pair of second guiding posts 70 in the longitudinal direction and the screws 30, 32, as shown in FIG. 2.

Referring to FIG. 3, the intermeshing of the various posts, ribs, and bridges of the folded-over body portions 12, 14 and the squeezing of the wires 38, 82 between the body portions 12, 14 is shown to illustrate implementation of strain relief on the wires 38, 82. In the example illustration of FIG. 3, ribs 72 of the first body portion 12 underlie the wires 82, over which the second body portion 14 is placed and pressed down during assembly of the completed electrical connector assembly 10, as shown in FIG. 4, providing a clamping force on the wires 82. The rib 88 extending downward from the second body portion 14 engages the section 92 of the wires 82 over the region 94 between the ribs 72. The various ribs, posts, and bridges, such as the ribs 72, 88 shown in FIG. 3, may have smooth and/or curved surfaces so that the wires 82 and/or their insulation are not broken or pierced. Thus, the wires 82 are held securely between the body portions 12, 14 to provide strain relief in a manner similar to the strain relief described in U.S. Pat. Nos. 5,934,931; 5,975,941; and 6,056,588, incorporated herein by reference.

However, as shown in FIGS. 1–2, the disclosed electrical connector assembly 10 with its extensions from the body portions 12–14, including posts, ribs, and bridges, also provide a path for the wires 38, 82 to be snugly held and to run from the exterior to the interior of the assembled electrical connector assembly 10, and also to separate the exposed ends 34, 36 to separately engage the respective screws 30, 32, with the series of posts, ribs, and bridges in the longitudinal direction providing multiple instances of strain relief to the wires 38, 82 and to the exposed ends 34, 36.

Thus, excellent strain relief is provided for a wide range of wire cord sizes without the need for additional parts, while also preventing overstressing the assembly screw 46 which, heretofore in the prior art, received the burden of compensating for strain on the wires 38, 82.

In alternative embodiments, the side walls 76 of the extension 74 may be tapered in the longitudinal direction toward the third body portion 16, to provide a lead-in for the wires 82, which may also be used in conjunction with the posts 70, 72 to assist in aligning the wires 82 to pass through the proper channel towards the screws 30, 32 in the assembled configuration of the electrical connector assembly 10.

In addition, the various posts, ribs, bridges, and other components, such as the extension 74 and the ribs 90, prevent the electrical connector device 24 and/or the contacts 26, 28 from being pushed out when the electrical connector assembly 10 is folded and closed, as shown in FIGS. 2 and 4, respectively, and when the electrical connector assembly 10 is in use.

Other advantages are provided by the use of the various posts, ribs, bridges, etc. For example, the bridge 84 and/or the rib 86 prevent objects as well as dust or other particulate matter from entering the interior of the electrical connector assembly 10 in the folded and closed configuration shown in FIG. 4.

In the preferred embodiments, the electrical connector assembly 10 also includes additional ribs and slots for providing advantages in addition to preventing intrusion by objects as well as dust or other particulate matter from entering the interior of the electrical connector assembly 10. For example, as shown in FIGS. 1–2, the first body portion 12 may include side walls 96 indented outward from the remainder of the first body portion 12, forming a slot 98 along the longitudinal length of the first body portion 12, for receiving a complementary elongated ribs 100 extending from the second body portion 14 when the electrical connector assembly 10 is folded, as shown in FIG. 2, to the assembled folded-and-closed configuration shown in FIG. 4.

Thus, the elongated ribs 100 provide excellent protection to the components such as the wires 82, their exposed ends 34, 36, and the electrical contacts 26, 28 in the interior of the assembled folded-and-closed electrical connector assembly 10, even if the electrical connector assembly 10 is not completely closed. In addition, the combination of elongated ribs 100 and slots 98 provide greater structural integrity to prevent bending or warping of the body portion 12, 14, for example, during any pulling of the wires 38, 82 in any direction, and so the electrical connector assembly 10 remains in the assembled configuration as shown, for example, in FIG. 4.

Furthermore, the combination of elongated ribs 100 and slots 98 aligns the body portions 12, 14 as the body portions 12, 14 are folded and assembled, as shown in FIG. 2, such that the various posts, ribs, bridges, and other components in the body portions 12, 14, especially such complementary components in the body portions 12, 14, are properly aligned for properly assembly of the electrical connector assembly 10. For example, the insertion of the elongated ribs 100 into the slots 98 presents the body portions 12, 14 from being moved askew, so, referring to FIG. 3, the rib 88 is properly aligned to engage the portion 92 of the wire 82 over the region 94 between the ribs 72.

In the preferred embodiment, additional ribs and components provide additional alignment mechanisms between the body portions 12, 14 as well as additional structural integrity of the folded and assembled electrical connector assembly 10. For example, the body 22 of the third body portion 16 includes a rib 80 which, during and/or after the folding of the second body portion 14 adjacent the first body portion 12, is disposed in the slot 78 of the extensions 74 as shown in FIG. 2. The rib 80 engaging the slot 78 prevents the body portions 12, 14 from misaligning during assembly and during use, such as when manipulation or movement of the wires 38, 82 apply sidewise or vertical pressure to the body portions 12, 14.

The rib 80 is preferably positioned between the contacts 26, 28 of the electrical connector device 24, and the rib 80 is preferably composed of insulating and/or non-conducting material. Accordingly, the rib 80 provides an additional function of maintaining electrical isolation between the contacts 26, 28 as well as the exposed ends 34, 36 of the wires 38, 82, so that shorts between the contacts 26, 28 are prevented. Thus, the rib 80 simultaneously aligns the body portions 12, 14 and electrically isolates the contacts 26, 28 during and after assembly of the electrical connector assembly 10.

In addition, referring to FIGS. 1–2, the body 22 of the third body portion 16 may also include slots 102 for engaging respective tabs 104, 106 on the body portions 12, 14, such that the tabs 104, 106 fit into the slots 102, as shown in FIG. 2, when the electrical connector assembly 10 is folded and assembled. The fitted engagement of the tabs 104, 106 in the slots 102 provides additional interlocking between the body portions 12–16, for example, to prevent the sides of the body portions 12–14 from spreading outward if one or both of the hinges 18, 20 wear out or are broken by pressure on the body portions 12–16, such as by movement of the wires 38, 82 during use of the assembled device as in FIG. 4.

Referring to FIG. 1, the body 22 of the third body portion 16 also includes an interlocking slot 108 and/or an interlocking groove 110 on one or both sides of the body 22 facing a respective body portion 12, 14, with the interlocking slot 108 and groove 110 engaging a respective interlocking tab 112 on the respective body portion 12, 14. During assembly as shown in FIG. 2, a portion of the interlocking tab 112 fits snugly into the interlocking slot 108, and/or a portion of the interlocking tab 112 fits snugly into the interlocking groove 110. Such engagement of the interlocking tab 112 on respective body portions 12, 14 into either or both of the interlocking slot 108 and/or the interlocking groove 110 provide additional structural integrity in the folded and assembled electrical connector assembly 10, as shown in FIG. 4.

For example, in the embodiments shown in FIG. 4, the third body portion 16 of the plug 42 has the interlocking slots 108 for engaging respective interlocking tabs 112 of respective body portions 12, 14 of the plug 42.

In use, the interlocking tabs 112 prevent the third body portion 16 from being pulled out from the folded electrical connector assembly 10 forming the plug 42, even if either or both of the hinges 18, 20, respectively connecting the body portions 12, 14 of the plug 42 to the third body portion 16, are broken or worn out.

The various features and advantages of the electrical connector assembly 10 are not dependent on the type of plug or socket to be connected to the wires 38, for example, since various features and advantages described herein are disposed in the regions of the body portions 12–16 which are internally located when the electrical connector assembly 10 is folded, as in FIG. 2, and completely assembled as in FIG. 4. Accordingly, the various features and advantages described herein may be embodied in diverse configurations of plugs and sockets as shown in FIGS. 5–10.

Figure 5:
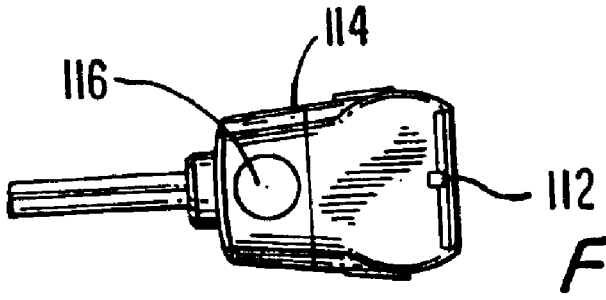
FIGS. 5–10 illustrate different top and side views of alternative embodiments of the folded and assembled electrical connector assembly of FIG. 1 in various plug configurations and socket configurations.

In one configuration 114 shown in the top view in FIG. 5, the assembled electrical connector assembly 10 may have a relatively compact shape, for example, having an attractive design such as curved body portions and a covering 116 in the recessed aperture 54 of one or both of the body portions to hide the screw 46 in the recessed aperture shown in FIG. 4. The configuration 114 may be either a plug or a socket.

Figure 6:
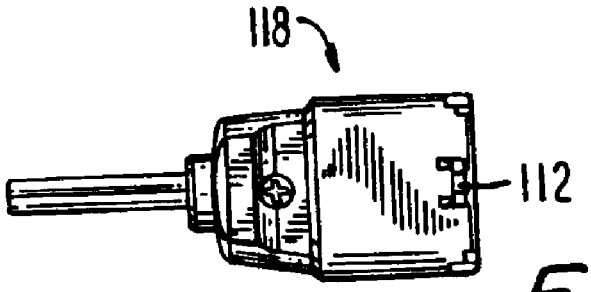
Figure 7:
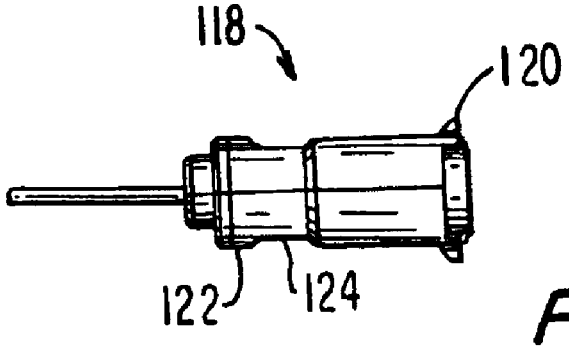

In an alternative configuration 118 shown in a top view in FIG. 6, which may be either a plug or a socket, the assembled electrical connector assembly 10 may have a more rectangular or box-like shape. For example, the configuration 118 may implement the plug 40 shown in FIG. 4. FIG. 7 illustrates a side view of the configuration 118 of FIG. 6 in which the configuration is a socket, with ridges 120 and curves 122 providing gripping regions such as region 124 for receiving portions of the fingers and thumbs of the user for inserting and removing the socket from plugs or other devices.

Figure 8:
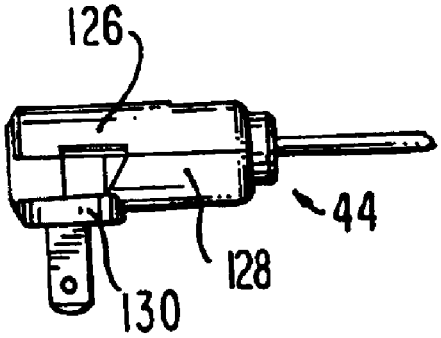

In another alternative embodiment, the configuration 44 shown in FIG. 8 implements a side-oriented plug, for example, for a two-prong plug, but alternatively the configuration 44 may include electrical contacts to implemented the configuration 44 as a three-prong plug. In the configuration 44, the upper portion 126 and the lower portion 128 include, internally, the same features described herein with reference to the body portions 12, 14, such as guiding posts 70, ribs 72, interlocking tabs 112, etc. and with an electrical connector portion 130 corresponding to the third body portion 16 but extending from the combination of the upper portion 126 and lower portion 128, for example, by extending through an aperture in the lower proton 128, or other known mounting techniques to secure the electrical connector portion 130 to the combination of the upper portion 126 and lower portion 128.

Figure 9:
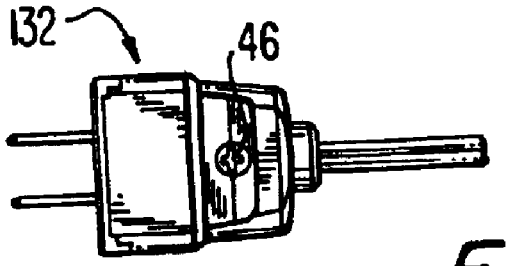
Figure 10:
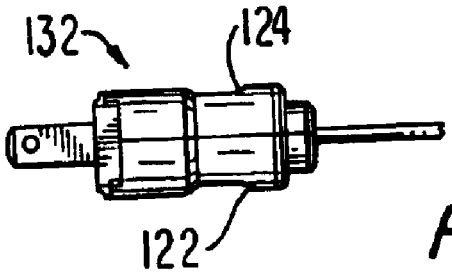

In another alternative configuration 132 shown in a top view in FIG. 9 implementing a plug, the electrical connector assembly 10 may have a more rectangular or box-like shape. For example, the configuration 132 may implement the plug 42 shown in FIG. 4, with a recessed screw 46. FIG. 10 illustrates a side view of the configuration 132 of FIG. 9 in which the configuration is a plug, with curves 122 providing gripping regions such as region 124 for receiving portions of the fingers and thumbs of the user for inserting and removing the plug 132 from a socket, such as the socket configuration 118 in FIG. 7, or from other devices.

Figure 11:
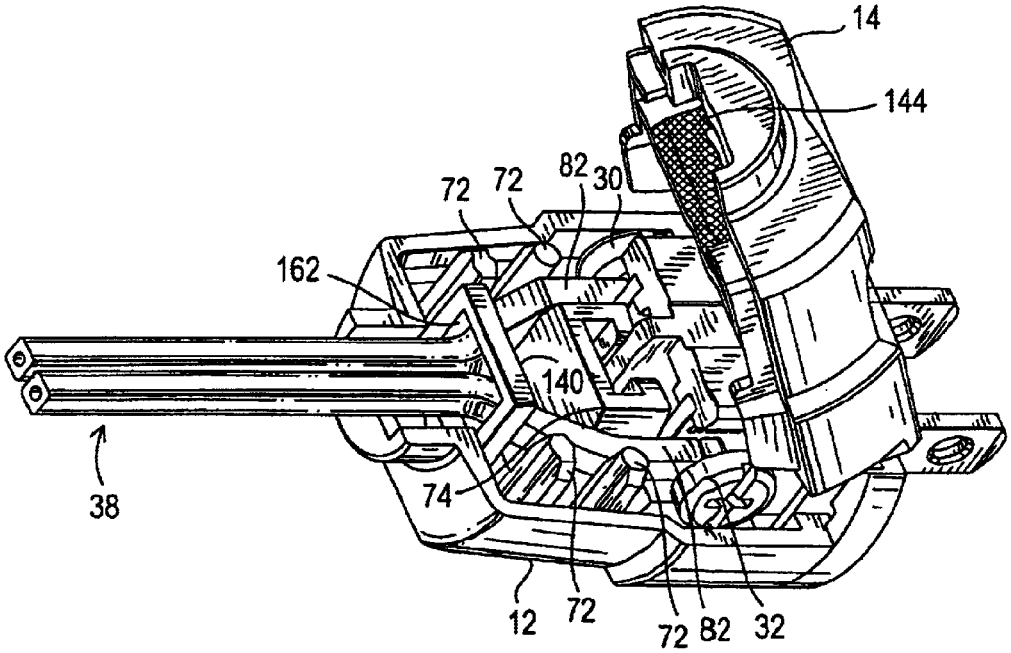
FIGS. 11–17 illustrate perspective and side views of yet another alternative embodiment of the present invention where the first and second body portions are secured with a snap fastening arrangement.
Figure 12:
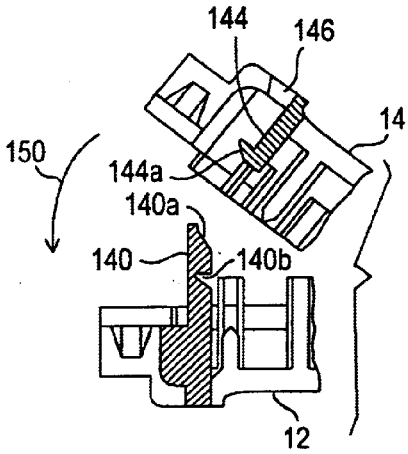
Figure 13:
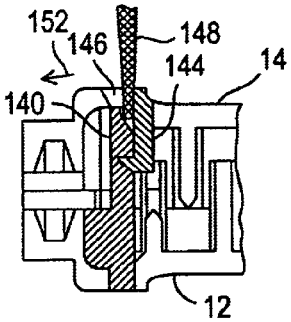

In another embodiment of the present invention, the body portions 12–14 are held together using a snap fastening arrangement as shown in FIG. 11. In FIG. 11, the snap fastening arrangement comprises first hook fastener 140 and second hook fastener 144. First hook fastener 140 and second hook fastener 144 are shown shaded for ease of clarity. First hook fastener 140 has an opening 162 through which insulated electrical wires 38 are routed. It should be noted that FIG. 11 shows two electrical wires being routed through opening 162. FIG. 11 is an illustration of one implementation of the apparatus of the present invention. The apparatus of the present invention is not limited to two wires being routed through the opening 162. Three or more wires can be routed through the opening 162 for different types of plugs. Referring now to FIG. 12, a side view of FIG. 11 showing the end portions of body portions 12 and 14 is depicted. First hook fastener 140 extends from the base of body portion 12 and is integral with body portion 12 as shown in FIGS. 12 and 13 which show side views of the ends of the body portions 12 and 14. Referring to FIG. 12, first hook fastener 140 has a head portion 140*a* and a notch 140*b*. Second hook fastener 144 which extends from and is integral with body portion 14, has a hook portion 144*a*. Body portion 14 has an opening 146 used to unfasten the body portions 12 and 14 from each other as discussed infra. Body portion 14 is moved (or rotated) with respect to body portion 12 in the direction shown by arrow 150 so as to fasten the three body portions (12, 16 and 14) of the foldable electrical connector assembly. When body portion 14 is moved in the direction shown by arrow 150, second hook fastener 144 engages first hook fastener 140 in the manner shown by FIG. 13. In particular, in FIG. 13, the hook 144*a* of second hook fastener 144 has a snap fit engagement with the notch 140*b* of first hook fastener 140. Still referring to FIG. 13, to unfasten body portion 14 from body portion 12, the head of a flat screw driver 148 is inserted in opening 146 to pry first hook fastener 140 away from second hook fastener 144 in the direction shown by arrow 152.

Figure 14:
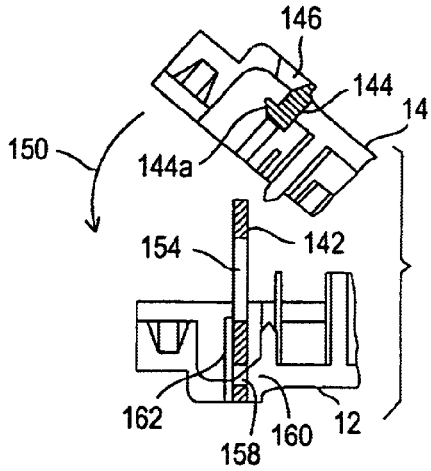
Figure 15:
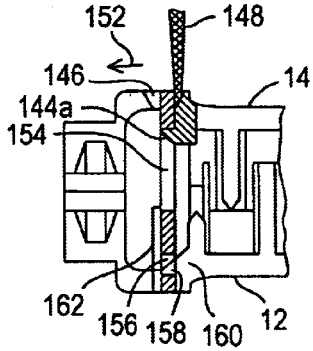
Figure 16:
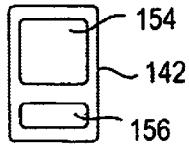

Referring now to FIG. 14, there is shown another implementation of a snap fit arrangement between body portions 12 and 14. In particular, a snap-clip 142 having two openings 154 and 156 (see FIG. 16) is securely mounted to body portion 12. Body portion 12 has a supporting wall 162 and hanging attachment member 160 with hook portion 158 between which snap-clip 142 frictionally fits allowing hook portion 158 to snap fasten snap-clip 142 via opening 156 of snap-clip 142 as shown in FIGS. 14 and 15. Still referring to FIG. 14, hook fastener 144 has a hook portion 144*a* which snaps into opening 154 of snap-clip 142 thereby making a snap fit engagement when body portion 14 is rotated in the direction shown by arrow 150 to fasten body portion 14 to body portion 12. FIG. 15 shows the two body portions (12, 14) fastened to each other using the snap-clip 142. Snap-clip 142 can be made from plastic material or metal. FIG. 15 also shows a head portion of a flat head screwdriver 148 inserted into opening 146 to pry snap-clip 142 in the direction shown by arrow 152 thereby allowing portion 14 to be unfastened from portion 12.

Figure 17:
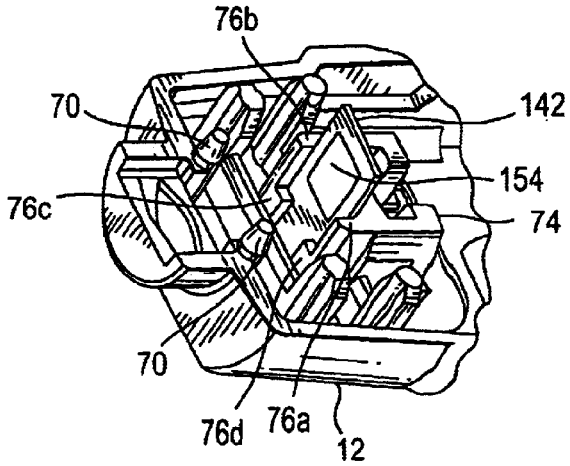

Another version of the snap-clip implementation is shown in FIG. 15 where snap-clip 142 is mounted onto body portion 12 within slots created by walls 76*a*, 76*b*, 76*c* and 76*d* of extension 74. Opening 156 of snap-clip 142 is hooked fastened (not shown in FIG. 17) in the same manner shown in FIGS. 14 and 15.

While there has been shown, described, and pointed out the fundamental novel features of the invention as applied to the preferred embodiment, as is presently contemplated for carrying it out, it is to be understood that various omissions, substitutions, and changes of the form and details of the invention illustrated and described herein and in its use and operation may be made by those skilled in the art, without departing from the spirit of the invention.

What is claimed is:

1. An electrical connector assembly comprising a plurality of body portions including:

a first body portion;

a second body portion; and a third body portion; and wherein the first body portion is attached to the third body portion by a first hinge;

wherein the second body portion is attached to the third body portion by a second hinge;

wherein the third body portion includes an electrical connector device having at least two electrical contacts;

wherein the first body portion includes:

an end wall having an entry opening for receiving an electrical wire having at least first and second separate conductors each having an exposed end; and first and second plurality of guiding posts extending outward a distance X from the inner surface of the first body portion and first and second ribs located between the first and second posts and extending outward a distance less than X from the inner surface of the first body portion, the first and second plurality of guiding posts forming first and second guiding paths along which the first and second conductors are held in position from the entry opening to the electrical contacts before the first and second body portions are folded into an assembled configuration, with the exposed conducting ends of the first and second conductors attached to the electrical contacts;

wherein the second body portion includes:

third and fourth ribs extending from an inner surface of the second body portion, the third and fourth ribs being complementary to the first and second ribs, respectively, of the first body portion; and wherein, when the first and second body portions are folded about the first and second hinges, respectively, with respect to the third body portion, with the first and second body portions secured together by a snap fastening arrangement comprising a first hook fastener and a second hook fastener where the first hook fastener has an opening through which the electrical wire passes, the third body portion is securely held between the secured first and second body portions;

wherein, with the first and second body portions secured together, the first and second ribs engage the third and fourth ribs, respectively, to secure the first conductor between the first and third ribs along the first path and the second conductor between the second and fourth ribs along the second path forming a strain relief combination of the first and second conductors by exerting a separate clamping force on the ends of the conductors; and wherein, with the first and second body portions secured together, a first extension partially blocks the entry opening with the first and second conductors extending therethrough.

2. The electrical connector assembly of claim 1, wherein the first hook fastener is a snap-clip having two openings with one opening allowing the electrical wire to pass therethrough and the other opening is used to secure the snap-clip to the first body portion.

3. The electrical connector assembly of claim 1, wherein the first plurality of extensions includes:

a first extension having a tapered side wall, with the first rib and the first extension forming the path for the electrical wire, with the tapered side wall guiding the fed electrical wire to the electrical contact.

4. The electrical connector assembly of claim 1, wherein the first body portion includes:

an interlock tab; and wherein the third body portion includes:

an interlock slot into which the interlock tab is inserted during the folding together of the first and second body portions, with the interlock tab disposed in the interlock slot preventing the third body portion from disengaging from the first body portion if either of the first and second hinges is broken.

5. The electrical connector assembly of claim 1, wherein the hinges are resilient hinges.

6. The electrical connector assembly of claim 1, wherein the first, second, and third body portions and the first and second hinges are integrally formed, with the first and second hinges being resilient living hinges between the respective body portions.

7. The electrical connector assembly of claim 1, wherein the second body portion includes:

a second hook fastener extending from and integral with the second body portion;

wherein the first body portion includes:

a first hook fastener having an opening through which the electrical wire passes and said first hook fastener engages the second hook fastener to secure the first and second body portions together.

8. The electrical connector assembly of claim 1, wherein the third body portion includes:

a plurality of slots; and wherein each of the first and second body portions includes:

a tab which fits into a respective slot of the third body portion wherein the first and second body portions are folded together, thereby securing the third body portion to the respective body portion of the respective tab.

9. The electrical connector assembly of claim 1, wherein the first plurality of extensions includes:

a first extension having a slot; and wherein the third body portion includes:

a rib which fits into the slot of the first extension wherein the first and second body portions are folded together, thereby securing the third body portion to the first extension.

10. The electrical connector assembly of claim 1, wherein the first body portion includes:

an elongated slot extending along a portion of a longitudinal length of the first body portion; and wherein the second body portion includes:

an elongated rib extending along a portion of a longitudinal length of the second body portion and being complementary to the elongated slot of the first body portion;

wherein, when the first and second body portions are folded together, the elongated rib fits into the elongated slot, thereby securing the second body portion to the first body portion.

11. The electrical connector assembly of claim 10, wherein the first body portion includes:

a side wall indented outward from the interior of the first body portion to form the elongated slot.

12. An electrical connector assembly comprising a plurality of body portions including:

a first body portion;

a second body portion; and a third body portion; and wherein the first body portion is attached to the third body portion by a first hinge;

wherein the second body portion is attached to the third body portion by a second hinge;

wherein the second body portion is attached to the third portion by a second hinge;

wherein the third body portion includes an electrical connector device having at least two electrical contacts;

wherein the first body portion includes:

a first hook fastener extending from and integral with the first body portion;

an end wall having an entry opening for receiving an electrical wire having at least first and second conductors each having an exposed end; and first and second plurality of guiding posts extending outward a distance X from the inner surface of the first body portion and first and second ribs located between the first and second posts and extending outward a distance less than X from the inner surface of the first body portion, the first and second plurality of guiding posts forming first and second guiding paths around the fastener receiving socket, with the first and second conductors being held in position along the first and second guiding paths from the entry opening to the electrical contact before the first and second body portions are folded into an assembled configuration with an exposed conducting end of each of the conductors attached to an electrical conduct;

wherein the second body portion includes:

a second hook fastener extending from and integral with the second body portion; and third and fourth ribs, extending from an inner surface of the second body portion, the third and fourth ribs being complementary to the first and second ribs, respectively, of the first body portion; and wherein, when the first and second body portions are folded about the first and second hinges, respectively, with respect to the third body portion, with the first and second body portions secured together by the first hook fastener engaging the second hook fastener forming a snap fastening arrangement, the third body portion is securely held between the secured first and second body portions;

wherein, with the first and second body portions secured together, the first and second pairs of ribs engage the third and fourth ribs, respectively, to secure the first conductor between the first and third ribs along the first path and the second conductor between the second and fourth ribs along the second path forming a strain relief combination on the first and second conductors by exerting a separate clamping force on each of the conductors; and wherein, with the first and second body portions secured together, a first extension partially blocks the entry opening with the first and second conductors extending therethrough and further extending through an opening in the first hook fastener.

13. The electrical connector assembly of claim 12, wherein the first hook fastener is a snap-clip having two openings with one opening allowing the electrical wire to pass therethrough and the other opening is used to secure the snap-clip to the first body portion.

14. The electrical connector assembly of claim 12, wherein the first plurality of extensions includes:

a first extension having a pair of tapered side walls, with the first pair of ribs and the pair of tapered side walls of the first extension forming the path for the electrical wire around the fastener receiving socket, with the pair of tapered side walls guiding the fed electrical wire to the electrical contact.

15. The electrical connector assembly of claim 12, wherein the first body portion includes:

an interlock tab; and wherein the third body portion includes:

an interlock slot into which the interlock tab is inserted during the folding together of the first and second body portions, with the interlock tab disposed in the interlock slot preventing the third body portion from disengaging from the first body portion if either of the first and second hinges is broken.

16. The electrical connector assembly of claim 12, wherein the hinges are resilient hinges.

17. The electrical connector assembly of claim 12, wherein the first, second, and third body portions and the first and second hinges are integrally formed, with the first and second hinges being resilient living hinges between the respective body portions.

18. The electrical connector assembly of claim 12, wherein the third body portion includes:

a plurality of slots; and wherein each of the first and second body portions includes:

a tab which fits into a respective slot of the third body portion wherein the first and second body portions are folded together, thereby securing the third body portion to the respective body portion of the respective tab.

19. The electrical connector assembly of claim 12, wherein the first plurality of extensions includes:

a first extension having a slot; and wherein the third body portion includes:

a rib which fits into the slot of the first extension wherein the first and second body portions are folded together, thereby securing the third body portion to the first extension.

20. The electrical connector assembly of claim 12, wherein the first body portion includes:

an elongated slot extending along a portion of a longitudinal length of the first body portion; and wherein the second body portion includes:

an elongated rib extending along a portion of a longitudinal length of the second body portion and being complementary to the elongated slot of the first body portion;

wherein, when the first and second body portions are folded together, the elongated rib fits into the elongated slot, thereby securing the second body portion to the first body portion.

21. The electrical connector assembly of claim 20, wherein the first body portion includes:

a side wall indented outward from the interior of the first body portion to form the elongated slot.

22. An electrical connector assembly comprising a plurality of body portions including:

a first body portion;

a second body portion; and a third body portion; and wherein the first body portion is attached to the third body portion by a first hinge;

wherein the second body portion is attached to the third body portion by a second hinge;

wherein the first, second and third body portions and the first and second hinges form an unfolded split body configuration extending longitudinally;

wherein the third body portion includes an electrical connector device having at least two electrical contacts;

wherein the first body portion includes:

a first hook fastener;

an end wall having an entry opening for receiving an electrical wire having at least first and second conductors each having an exposed end; and first and second guiding posts extending outward a distance X from the inner surface of the first body portion and first and second ribs located between the first and second posts and extending outward a distance less than X from the inner surface of the first body portion, the first and second plurality of guiding posts forming first and second guiding paths around the fastener receiving socket, with the conductors of the electrical wire being held in position along the first and second conductors guiding path from the entry opening to the electrical contacts before the first and second body portions are folded into an assembled configuration, with the exposed conducting ends of the first and second conductors attached to the electrical contacts;

wherein the second body portion includes:

a second hook fastener; and third and fourth ribs extending from an inner surface of the second body portion, the third and fourth ribs being complementary to the first and second ribs, respectively, of the first body portion; and wherein, when the first and second body portions are folded about the first and second hinges, respectively, from the unfolded split body configuration about a transverse axis perpendicular to the longitudinal length of the split body, with respect to the third body portion, with the first and second body portions secured together by the single screw passed through the single screw aperture and securely engaging the single screw-receiving socket, the third body portion is securely held between the secured first and second body portions;

wherein, with the first and second body portions secured together by the engagement of the first hook fastener to the second hook fastener forming a snap fastening arrangement, the first and second ribs engage the third and fourth ribs, respectively, to secure the first conductor between the first and third ribs along the first path and the second conductor between the second and fourth ribs along the second path, forming a strain relief combination of the first and second conductors by exerting a separate clamping force on each of the conductors; and wherein, with the first and second body portions secured together, a first extension partially blocks the entry opening with the first and second conductors extending therethrough.

23. The electrical connector assembly of claim 22, wherein the first hook fastener is a snap-clip having two openings with one opening allowing the electrical wire to pass therethrough and the other opening is used to secure the snap-clip to the first body portion.

* * * * *

UNITED STATES PATENT AND TRADEMARK OFFICE

CERTIFICATE OF CORRECTION

PATENT NO. : 6,902,423 B2
DATED : June 7, 2005
INVENTOR(S) : Castaldo et al.

It is certified that error appears in the above-identified patent and that said Letters Patent is hereby corrected as shown below:

Column 12,
Lines 27-28, delete "wherein the second body portion is attached to the third portion by a second hinge;"

Signed and Sealed this

Eleventh Day of April, 2006

JON W. DUDAS
*Director of the United States Patent and Trademark Office*